US008044559B2

(12) United States Patent
Iguchi et al.

(10) Patent No.: US 8,044,559 B2
(45) Date of Patent: Oct. 25, 2011

(54) DISCHARGE LAMP OF THE SHORT ARC TYPE AND A LIGHT SOURCE DEVICE HAVING THE DISCHARGE LAMP OF THE SHORT ARC TYPE

(75) Inventors: Takehiko Iguchi, Himeji (JP); Hitoshi Nakabayashi, Himeji (JP); Katsuoki Miyasu, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 61 days.

(21) Appl. No.: 12/332,765

(22) Filed: Dec. 11, 2008

(65) Prior Publication Data

US 2009/0146540 A1 Jun. 11, 2009

(30) Foreign Application Priority Data

Dec. 11, 2007 (JP) ..... 2007-319720

(51) Int. Cl.
*H01J 9/00* (2006.01)

(52) U.S. Cl. ..... 313/43; 313/35; 362/294

(58) Field of Classification Search ..... 313/26, 313/35, 42–46, 17; 362/255, 256, 294, 373
See application file for complete search history.

(56) References Cited

U.S. PATENT DOCUMENTS

| | | | | |
|---|---|---|---|---|
| 4,970,431 | A * | 11/1990 | Vegter et al. | 313/634 |
| 2004/0052027 | A1* | 3/2004 | Stewart et al. | 361/118 |
| 2004/0095765 | A1* | 5/2004 | Hataoka et al. | 362/263 |
| 2006/0170318 | A1 | 8/2006 | Morimoto et al. | |
| 2007/0013281 | A1* | 1/2007 | Miyasu et al. | 313/24 |

* cited by examiner

*Primary Examiner* — Toan Ton
*Assistant Examiner* — Andrew Coughlin
(74) *Attorney, Agent, or Firm* — Roberts Mlotkowski Safran & Cole, P.C.; David S. Safran

(57) ABSTRACT

A discharge lamp of the short arc type has a bulb with an arc tube and sealing tubes extending at opposite sides of the arc tube and which contains a discharge gas and a pair of opposed electrodes supported on lead pins which protrude from the outer end of the sealing tubes, the lead pins being affixed to graded glass in the sealing tube. A cooling fin surrounds the outer surface of one of the sealing tubes; and is formed of a pair of plate-shaped bodies each of which has a curved portion that contacts an outer surface of the sealing tube a strip-shaped portion extending radially from each of opposite edges of the curved portion. The strip-shaped portions of the plate-shaped bodies positionally overlap, and cooling openings are formed in the strip-shaped portions of only one of the plate-shaped bodies. Preferably, a gap is formed between the plate-shaped bodies.

5 Claims, 8 Drawing Sheets

(A-A′ cross-sectional view)

(B-B′ cross-sectional view)

(A-A′ cross-sectional view)

(B-B′ cross-sectional view)

(A-A′ cross-sectional view)

DISCHARGE LAMP OF THE SHORT ARC TYPE AND A LIGHT SOURCE DEVICE HAVING THE DISCHARGE LAMP OF THE SHORT ARC TYPE

BACKGROUND OF THE INVENTION

1. Field of Invention

The present invention relates to a light source device comprising a discharge lamp of the short arc type used as a light source for a projection apparatus wherein light is applied to a light modulation device and an image is produced by the reflected light.

2. Description of Related Art

As known from commonly owned U.S. patent application Ser. No. 11/340,456 published as Publication No. 2006/0170318, a discharge lamp A of the short arc type (hereinafter simply a "lamp") having xenon gas in an arc tube B, as shown in FIG. 13, is a known light source for projection apparatus, such as projectors. The lamp A, comprising a bulb D having arc tube B, a sealing tube C formed at both ends of the arc tube B, has a anode E and cathode F paired and placed opposite each other inside the arc tube B, Lead pins G support the anode E and the cathode F and are structured so as to protrude outward from the outer edge of sealing tubes C.

Due to the very high pressure resulting inside the arc tube B when lit, to increase radiance, this lamp must be structured so that the sealing tubes C will not break even under high internal pressure, and the lead pins G must protrude from the outer end of the sealing tubes C for electric power to be supplied to the lamp A. Therefore, sealing parts I are formed in the lamp A by using graded glass H on the lead pins G and sealing tubes C.

In recent years, however, due to the trend toward carrying projection apparatus, such as projectors incorporating a lamp such as lamp A, and using them in various locations, there is a demand for smaller projection apparatus, and therefore, smaller lamps. In order to make lamps smaller, the lamp length must be shortened, and in a lamp such as that shown in FIG. 13, the distance L between the back end portion EA of the anode E and the sealing part I must be shortened. However, it has been found that, when shortening this distance L, the sealing part I and the anode E become closer and the temperature of the sealing part I increases due to the high temperature of the anode E when the lamp is lit, thereby causing a problem in which the sealing part I is damaged.

The anode E and the cathode F are placed opposite each other inside the arc tube B, and the lead pins G which support this anode E and cathode F pass through cylindrical retaining bodies J. The portion of the sealing tube C where these cylindrical retaining bodies J are located is heated up, thereby decreasing the diameter to form a pinched part K.

In this pinched part K, the space between the inner face of the openings through which the lead pins G of the cylindrical retaining bodies J pass and the outer face of the lead pins G is not completely welded. The internal space of the arc tube B and the internal space of the sealing tubes C is continuous. A problem occurred in which the gas in the internal space of the arc tube A, which is in a high temperature state, flowed into the sealing tube C, and came into contact with the sealing parts I of the graded glass H, damaging the sealing parts I.

Taking such situations into consideration, to make it possible to cool the discharge gas which flows into the sealing tube C, even if the above-mentioned distance L is shortened in the discharge lamp of the short arc type disclosed in the above noted U.S. Patent Application Publication No. 2006/0170318, a sealing tube cooling component M has been provided on the outside face of the sealing tube C and a lead pin cooling component N has been provided around the circumference of the lead pin G which protruded from the outer edge of the sealing tube C. In so doing, cooling air is blown onto the sealing tube cooling component M and sealing tube C is indirectly cooled through the sealing tube cooling component M, which is cooler than the sealing tube C, thereby decreasing the temperature of the discharge gas which flows inside the sealing tube C. Therefore, it is believed that damage to the sealing part I can be prevented.

However, when the above-mentioned lamp A was actually produced and operated, the temperature of the discharge gas flowing through the inside of the sealing tube C could not be sufficiently decreased for the following reasons, and the sealing part I was occasionally damaged.

As shown in FIG. 14, the sealing tube cooling component M, comprising a plate-shaped body MA having an arc-shaped curved portion MA1 which comes into contact with the sealing tube C and strip-shaped part MA2 which is continuous from the edge of curved part MA1, and another plate-shaped body MB having an arc-shaped curved portion MB1 and plate-shaped part MB2 which is continuous from the edge of curved part MB2, is structured such that the pinnated parts MA2, MB2 overlap. When one strip-shaped body MA is placed in the upstream direction of the airflow, the cooling air only blows directly onto the strip-shaped body placed in the upstream direction of the airflow. The cooling air never directly comes into contact with the other plate-shaped body MB. Therefore, the other plate-shaped body MB is only cooled indirectly by thermal conduction from the plate-shaped body MA through the strip-shaped bodies MA2, MB2 which are mutually adjacent. Therefore, the plate-shaped body MB will be in a higher temperature state than the plate-shaped body MA. As a result, the temperature at the locations in the sealing tube C with which the curved part MB1 of the other plate-shaped body MB comes into contact will not decrease, so it is assumed that the temperature of the discharge gas flowing inside the locations was not sufficiently reduced.

The above-mentioned problem can conceivably be solved by placing both plate-shaped bodies in the upstream direction of the airflow, or more specifically, using a plurality of cooling mechanisms between which both plate-shaped bodies are placed, and having cooling air blow onto both plate-shaped bodies from both directions, thereby cooling both plate-shaped bodies. However, providing a plurality of cooling mechanisms has the disadvantages that the projection apparatus in which the discharge lamp of the short arc type is mounted consequently becomes larger, going against the above-mentioned demand for smaller size, and the noise generated by the projection apparatus becomes excessive, thereby annoying the user.

SUMMARY OF THE INVENTION

Accordingly, an object of the present invention is to prevent damage to the sealing part in the sealing tube by reliably cooling the sealing tube and sufficiently lowering the temperature of the discharge gas flowing inside the sealing tube in a discharge lamp of the short arc type wherein a cooling component is attached to the outer surface of sealing tubes continuing to both ends of the arc portion.

Another object is to prevent damage to the sealing part of a sealing tube in a light source device having such a discharge lamp of the short arc type.

The present invention is characterized in that, in a discharge lamp of the short arc type comprising a bulb having an arc tube and sealing tubes continuously extending from a respective end of the arc tube, with discharge gas and a pair of opposed electrodes inside the arc tube, lead pins which support the electrodes protruding from the outer end of the sealing tube being affixed to graded glass in the sealing tube, a cooling fin that surrounds the outer surface of the sealing tube and has curved portions that contact the outer surface of the sealing tube and plate-shaped bodies, which are placed adjacent to each other extending radially from the edges of the curved portions, are provided with cooling openings in only one of the plate-shaped bodies.

Furthermore, a gap is formed between the pair of plate-shaped bodies to allow cooling air to pass through the cooling openings to the arc tube. Preferably, the gap gradually increases in the tube axial direction of the bulb as the distance to the arc tube decreases.

The present invention is further characterized in that the surface areas of the curved portions of the plate-shaped bodies that are in contact with the sealing tube are covered with a heat absorbing material. Advantageously, the at least part of the outer surface of the sealing tube is covered by a heat absorbing material in addition or instead.

A light source device comprising the discharge lamp of the short arc type of the invention is characterized in that it has a casing comprising a light exit opening for outputting light from the short arc discharge lamp and a cooling air inlet for introducing cooling air, wherein the discharge lamp of the short arc type is arranged so that the tube axis of the lamp extends along the light output path; and the plate-shaped body having the openings faces opposite the cooling air inlet to allow the cooling air introduced into the casing to pass through the cooling openings.

With the discharge lamp of the short arc type of present invention, the cooling fin has cooling air directly blown onto the first plate-shaped body provided with the cooling openings and, since the cooling air passes through the openings, also directly onto the second plate-shaped body, so that both plate-shaped bodies can be reliably cooled. The sealing tube can be reliably cooled by having the curved portion of each cooled plate-shaped body come into contact with the outer surface of the sealing tube and the temperature of the discharge gas which flows inside the sealing tube can be lowered, thereby reliably preventing damage to the sealing part.

Furthermore, because a gap for introducing cooling air which passed through the cooling air openings towards the arc tube has been formed between the pair of plate-shaped bodies, the arc tube, which operates at high temperature when the lamp is lit, can be reliably cooled by having cooling air which passes through the gap contact the outer surface of the arc tube.

Because the gap between the pair of plate-shaped bodies gradually widens in the axial direction of the bulb closer to the arc tube, cooling air which passed through the cooling air openings can be reliably directed towards the arc tube.

The face of the curved portion of the second plate-shaped body which does not have any cooling air openings and comes into contact with the sealing tube is covered by a heat absorbing material, thereby making it possible to reliably achieve a sufficient cooling effect on the sealing tube.

Because the outer surface of the sealing tube is at least partly covered by heat absorbing material, a sufficient cooling effect of the sealing tube can be reliably achieved.

By having a discharge lamp of the short arc type placed such that the tube axis of the bulb extends in the light output direction and the discharge lamp of the short arc type is placed inside a casing having a cooling air inlet for introducing cooling air, and placing a plate-shaped body having cooling air openings opposite the cooling air inlet, the cooling air introduced inside the casing will directly blow onto that first one of the plate-shaped bodies then the cooling air that passes through the opening of the first plate-shaped body will also directly blow onto the plate-shaped portion of the second plate-shaped body. Therefore, both plate-shaped bodies can be reliably cooled.

DETAILED DESCRIPTION OF THE INVENTION

Figure 1:
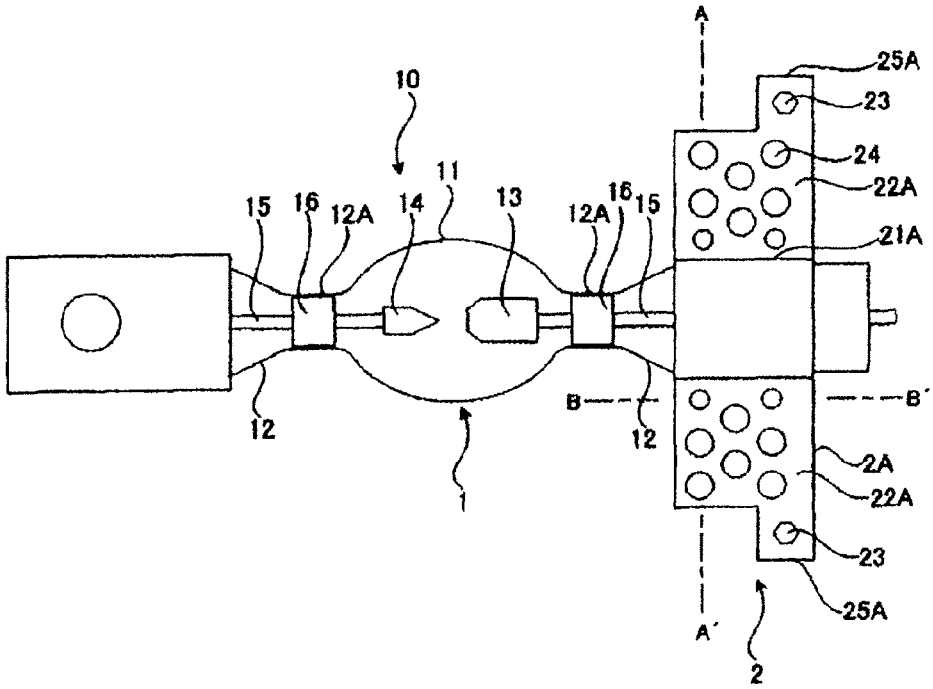
FIG. 1 is side view of the overall structure of a discharge lamp of the short arc type according to the present invention.
Figure 2:
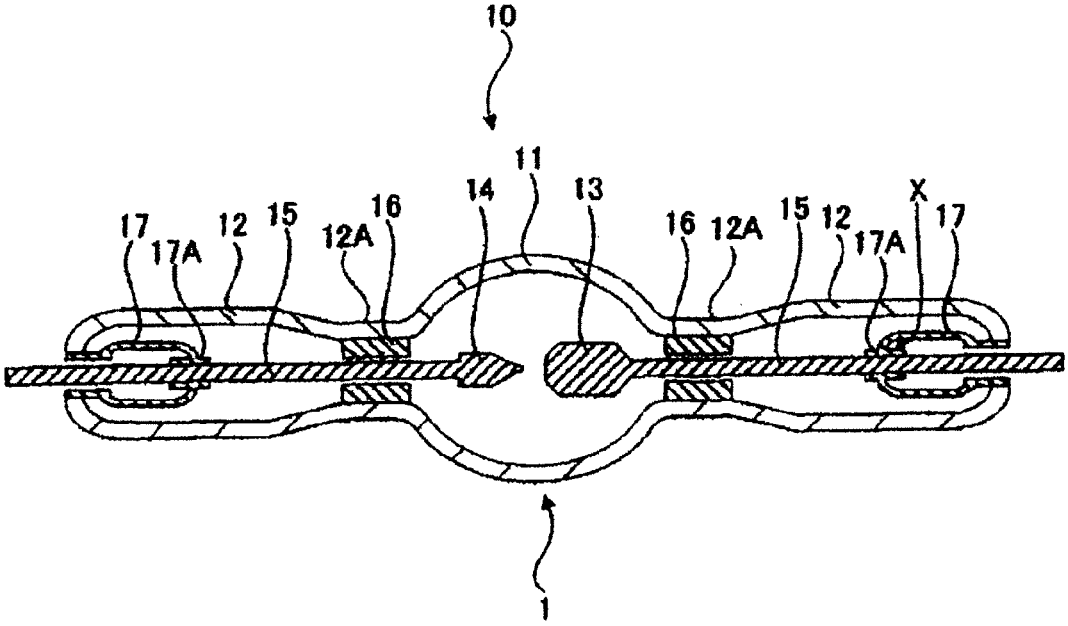
FIG. 2 is a longitudinal cross-sectional view of the bulb structure relating to the discharge lamp of the short arc type according to the present invention.
Figure 4:
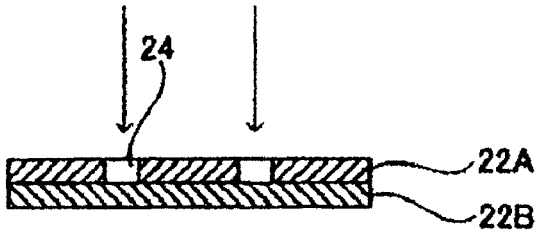
FIG. 4 is cross-sectional view taken along the line B-B' in FIG. 1.

FIGS. 1 & 4 are used to explain a first example of a discharge lamp of the short arc type relating to the present invention. The discharge lamp 10 of the short arc type (hereinafter "lamp 10") has an arc-shaped arc tube 11, sealing tubes 12 continuing to both ends of the arc tube 11, and a bulb 1 composed of quartz glass, for example. A noble gas, such as xenon, argon, or krypton or a mixture of these gasses is disposed inside of the arc tube 11 as a discharge gas, and an anode 13 and cathode 14 composed of a metal with a high melting point, such as tungsten, are placed opposite each other in the arc tube 11.

The tip of the lead pins 15 made from tungsten support the base of the anode 13 and the cathode 14, each of the lead pins 15 extends axially along the tube axis of the bulb 1 inside a respective one of the sealing tubes 12 with the base portion thereof protruding from the outer end of the respective sealing tube 12.

Cylindrical retaining bodies 16 composed from cylindrical quartz glass are placed at locations inside of the sealing tube 12 closer to the arc tube 11. The location at which the cylindrical retaining bodies 16 are located in the sealing tubes 12 is constricted through thermal compression to form pinched parts 12A, thereby securing the cylindrical retaining bodies 16. By inserting the lead pins 15 through the openings provided in the center of the cylindrical retaining bodies 16, the anode 13 and the cathode 14 are fixed in a predetermined position inside of the bulb 1. However, the space between the inner face of the cylindrical retaining bodies 16 defining the openings and the outer face of the lead pins 15 is not completely welded so that the interior space of the arc tube 11 and the interior space of the sealing tubes 12 are connected. Therefore, discharge gas inside the arc tube 11 that reaches a high temperature when the lamp is lit flows into the sealing tubes 12.

Graded glass 17 is placed inside the sealing tubes 12. The graded glass 17 is sealed to the outer end of the sealing tubes 12 at an end which has a thermal expansion coefficient roughly equal to that of the quartz glass from which the sealing tube 12 is formed, and the other end forms a sealed portion 17A that has a thermal expansion coefficient roughly equal to that of the tungsten from which the lead pins 15 is made to which it is sealed.

Figure 3:
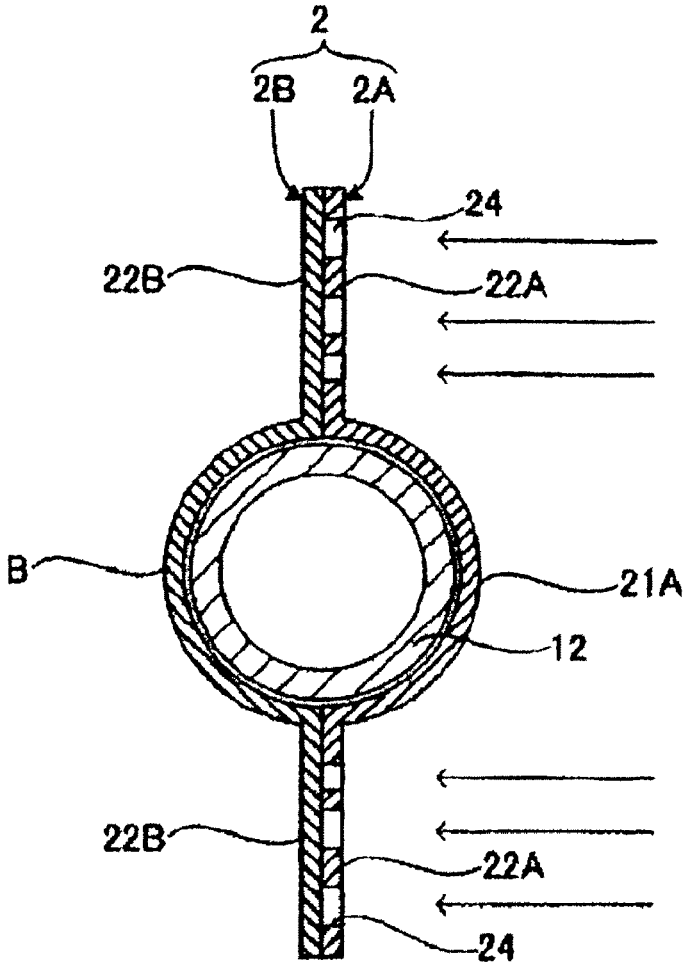
FIG. 3 is a cross-sectional view taken along the line A-A' in FIG. 1.

As shown in FIG. 3, a cooling fin 2 comprising an overlapping pair of plate-shaped bodies 2A, 2B, both of which are made of copper, is provided on the outside of the one of the sealing tubes 12 that is on the side of the anode 13. The cooling fin 2 comprises a plate-shaped body 2A having a semi-circularly curved portion 21A which comes into contact with the outer surface of the sealing tube 12 and is matched to the shape of the outside surface of the sealing tube 12, and a pair of strip-shaped portions 22A extending radially from the sealing tube 12. The strip-shaped portions 22A are connected to opposite edges of the curved portion 21A. The cooling fin 2 also comprises another plate-shaped body 2B having a curved portion 21B which comes into contact with the outside surface of the sealing tube 12 and which is curved into a semicircular shape matched to the shape of the outside surface of the sealing tube, and a pair of strip-shaped portions 22B extending radially relative to the sealed portion 12 at opposite edges of the curved portion 21B. The strip-shaped portions 22A, 22B overlap and are connected to each other at narrow portions 25A, 25B. The narrow portions 25A are narrower in the axial direction of the bulb than strip-shaped portions 22A and protrude from the outer edge of the strip-shaped portions 22A. Similar to strip-shaped portions 22A, narrow portions 25B are also formed on strip-shaped portions 22B. In order to keep the strip-shaped portions 22A and the strip-shaped portions 22B close together without separating, the plate-shaped body 2A and the second plate-shaped body 2B are fastened together by screws 23 passing through holes formed in the narrow portions 25A and the narrow portions 25B.

The strip-shaped portion 22A of the first plate-shaped body 2A has a plurality of spaced apart cooling air openings 24, to allow cooling air to pass through them, whereas the second plate-shaped body 2B has no cooling air openings on the strip-shaped portion 22B thereof. Forming a large number of the cooling air openings 24 makes it easier for the cooling air to pass through first plate-shaped body 2A so as to strike against the second plate-shaped body 2B. However, when the ratio of the surface area of the first plate-shaped body 2A to the total aperture area combining the area of all cooling air openings 24 is too great, the cooling effect of the sealing tube 12 by plate-shaped body 2A is lessened. Conversely, if the ratio is too small, the amount of cooling air striking the second plate-shaped body 2B decreases, so an area ratio within the range of 20% to 30% is preferred.

The cooling fin 2 such as this is provided on the sealing tube 12 of the anode 13 as explained below, for example.

The first plate-shaped body 2A is placed such that the semicircular curved portion 21A thereof comes into contact with the outer surface of the sealing tube 12, the second plate-shaped body 2B is placed such that the semicircular curved portion 21B thereof comes into contact with the outer surface of the sealing tube 12, the strip-shaped portions 22A and the strip-shaped portions 22B thereof are kept close together, and the screws 23 are inserted and tightened to fasten the narrow parts 25A to the narrow parts 25B through the holes formed therein.

Figure 5:
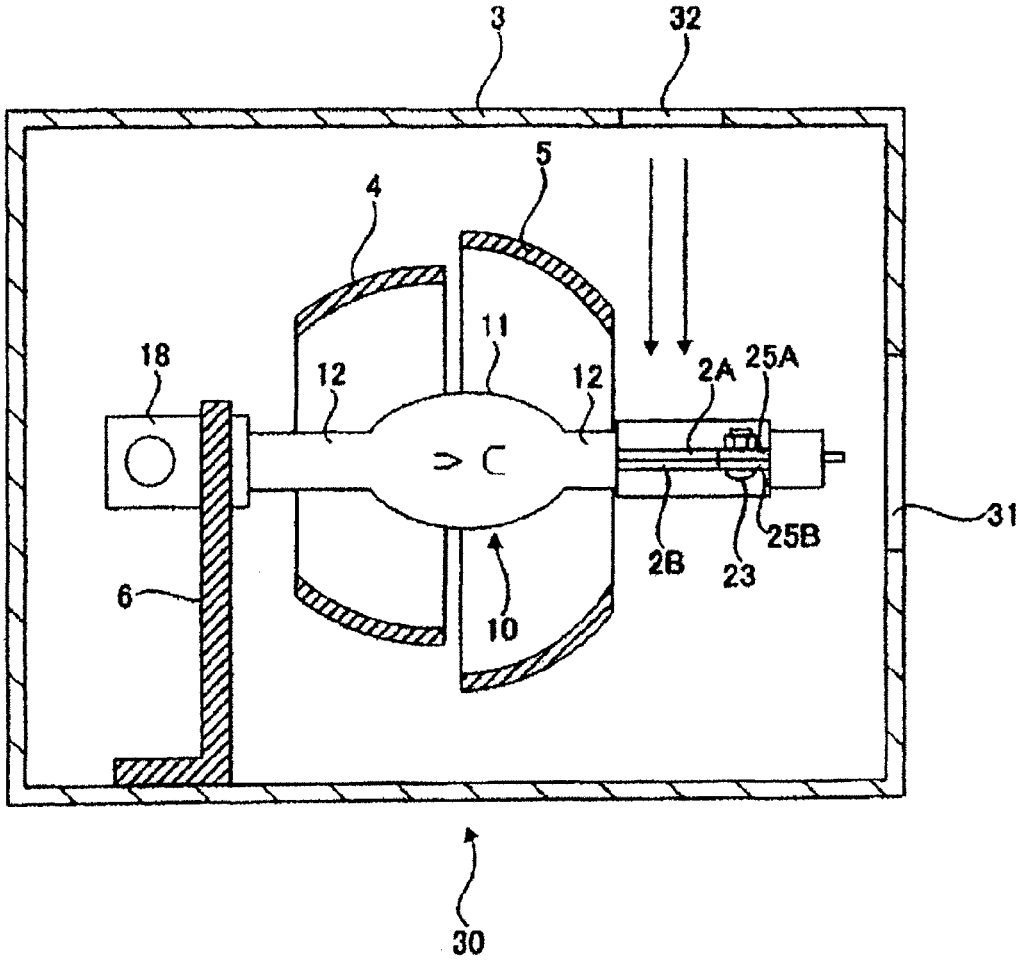
FIG. 5 is a longitudinal cross-sectional view of the overall structure of a light source device according to the present invention.

FIG. 5 is a longitudinal cross-sectional view of the overall structure of a light source device according to the present invention. As shown in the figure, a light source device 30 comprises a casing 3 having a circular light exit opening 31 and a cooling air inlet 32, wherein a discharge lamp 10 of the short arc type is placed such that the tube axis of the bulb 1 extends in the light output direction, two reflecting mirrors 4, 5 are placed facing the light exit opening 31 to reflect the light emitted from the lamp 10, and a support body 6 which is attached to one of the sealing tubes 12 of the lamp 10 for supporting a base 18.

The reflecting mirror 4, which is placed behind the reflecting mirror 5 with respect to the direction of the light output, is an ellipsoidal condensing mirror wherein the first focal point thereof matches that of the arc spot which is formed between the anode 13 and the cathode 14 in the bulb 1. The reflecting mirror 5, which is placed in front of the reflecting mirror 4 with respect to the direction of the light output, is a spherical reflection mirror wherein the focal point thereof matches that of the arc spot which is formed between the anode 13 and the cathode 14 in the bulb 1. By providing two reflection mirrors such as reflection mirrors 4, 5, either some of the light is directly radiated from the bulb 1 or is reflected from the reflecting mirror 4 and radiated outward from the light exit opening 31. In addition, the light which is directed forward and outward from the outward edge of the reflecting mirror 4 is returned to the arc spot by the second reflecting mirror 5, then is collected by the reflecting mirror 4 and is radiated outward from the light exit opening 31.

The lamp 10 is fastened inside the casing 3 such that the plate-shaped body 2A in which cooling air openings 24 are formed in the cooling fin 2 thereof is oriented opposite the cooling air inlet 32 which is formed in the casing 3, and the rear sealing tube 12 with respect to the light exit direction is supported by the support body 6 and fastened on one side thereof. In other words, the cooling fin 2 is placed such that the first plate-shaped body 2A having the cooling air openings 24 and the second plate-shaped body 2B not having the cooling air openings are placed under the air flow. The support body which supports the lamp 10 can also support a pair of sealing tubes 12.

In the light source device 30, while the lighting of the lamp 10 is driven by a power supply device, cooling air is introduced from the cooling air inlet 32 to inside the casing by a cooling air supply device not shown here. As shown by the arrows in FIGS. 3 & 4, the cooling air is directly blown onto the plate-shaped body 2A which is positioned in the upstream direction of the airflow. Part of the cooling air is directly blown onto the second plate-shaped body 2B through the cooling air openings formed in the plate-shaped body 2A.

According to the present invention, by placing the discharge lamp of the short arc type 10 such that a first plate-shaped body 2A having cooling air openings 24 is positioned in the upstream direction of the airflow, the cooling air from the cooling air inlet 32 is introduced into the casing 3, thereby directly cooling the first plate-shaped body 2A and the second plate-shaped body 2B of the cooling fin 2. Therefore, cooling can be efficiently carried out through both the plate-shaped body 2A which is in contact with the sealing tube 12 of the bulb 1 and the second plate-shaped body 2B. Also, because the temperature of the discharge gas flowing inside the sealing tube 12 can be lowered more than was previously possible, damage to the sealed portion 17A which is formed in the sealing tube 12 can be reliably prevented.

Figure 6:
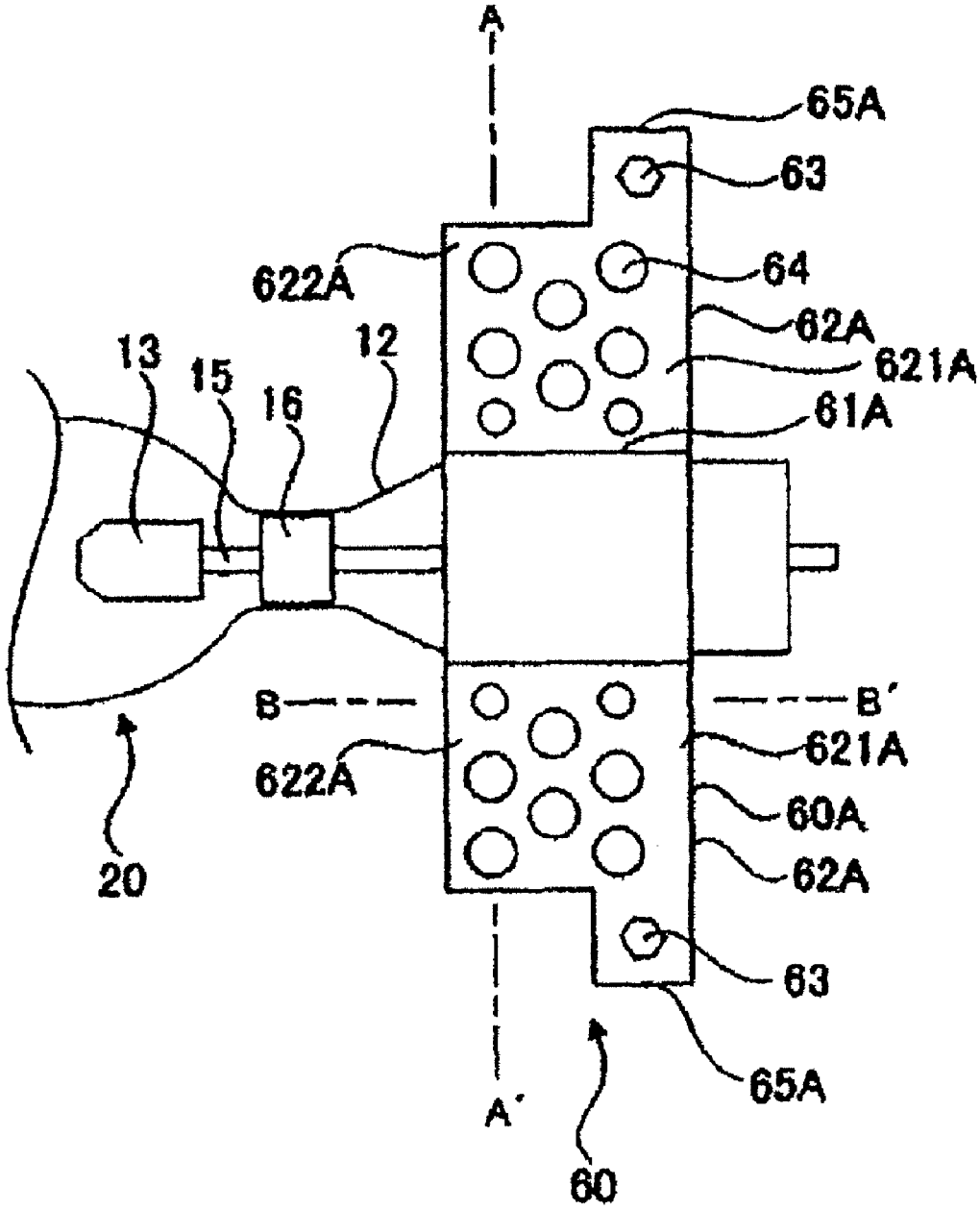
FIG. 6 is an enlarged view of important parts required to explain a second example of the discharge lamp of the short arc type according to the present invention.
Figure 7:
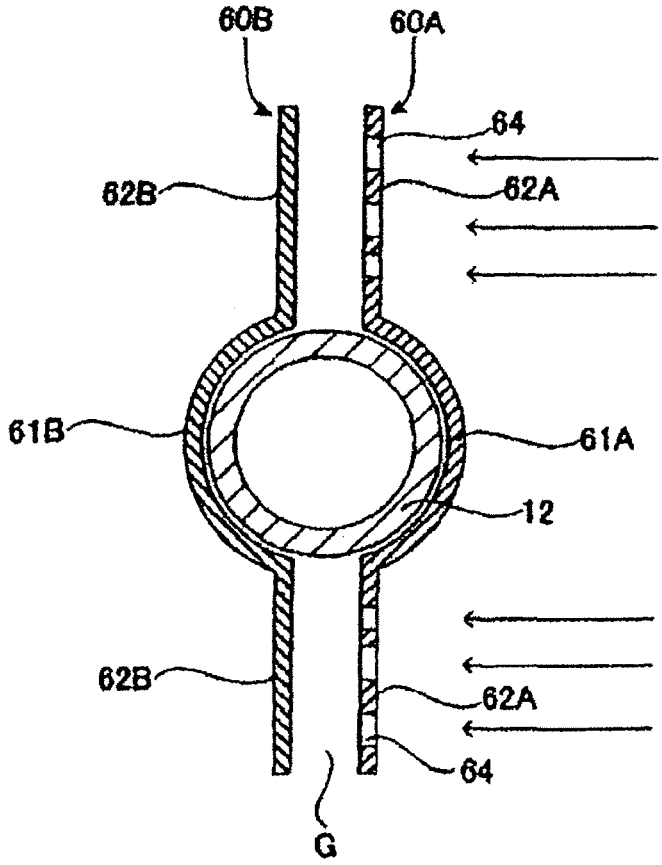
FIG. 7 is a cross-sectional view of the cooling fin and sealing tube along the line A-A' shown in FIG. 6.
Figure 8:
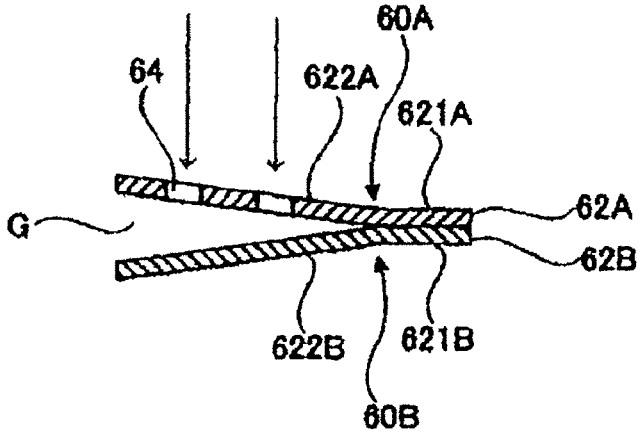
FIG. 8 is a cross-sectional view of the cooling fin along the line B-B' shown in FIG. 6.
Figure 9:
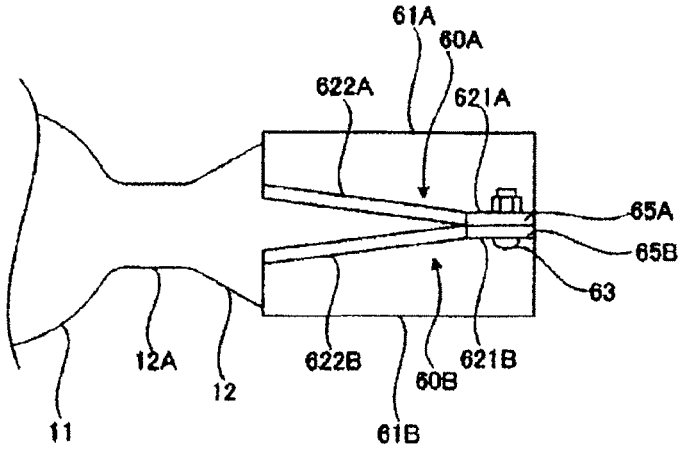
FIG. 9 is a side view of the discharge lamp of the short arc type viewed in a direction perpendicular to that of FIG. 6.

Next, FIGS. 6 & 9 will be used to explain a second example of a discharge lamp of the short arc type in accordance with the present invention. FIG. 6 is an enlarged view of the main parts needed to explain a discharge lamp of the short arc type in accordance with the present invention. FIG. 7 is a cross-sectional view of the cooling fin and sealing tube taken along the line A-A' shown in FIG. 6. FIG. 8 is a cross-sectional view of the cooling fin taken along the line B-B' shown in FIG. 6. FIG. 9 is a side view of the discharge lamp of the short arc type as seen in a direction perpendicular to that shown in FIG. 6.

As shown in FIG. 7, a cooling fin 60 comprises: a plate-shaped body 60A having a curved portion 61A which comes into contact with the outer surface of the sealing tube 12 having an arc-shaped curvature to fit the outer shape of the sealing tube 12, and a pair of strip-shaped parts 62A which extend from both ends of the curved portion 61A and extend radially outward relative to the sealing tube 12; and another plate-shaped body 60B having a curved portion 61B which comes into contact with the outer surface of the sealing tube 12 and has an arc-shaped curvature to fit against the outer shape of the sealing tube 12, and a pair of strip-shaped parts 62B which extend from both ends of the curved portion 61B in a radially outward direction with respect to the sealing tube 12.

As shown in FIGS. 7-9, a gap G is formed in the cooling fin 60 between the plate-shaped bodies 60A, 60B, the gap G extending along the tube axis of the bulb 1. A plurality of cooling air openings 64, which are mutually separated, are formed on the strip-shaped portion 62A of the plate-shaped body 60A to allow cooling air to pass through, while no cooling air openings are been formed on the strip-shaped portion 62B of the second plate-shaped body 60B.

The strip-shaped portion 62A of plate-shaped body 60A comprises joining parts 621A extending parallel to the tube axis of the bulb 1, and slanted portions 622A which are continuous with the joining parts 621A and extend diagonally outward (upward as seen in FIGS. 8 & 9). The strip-shaped portion 62B of the second plate-shaped body 60B comprises joining parts 621B extending parallel to the tube axis of the bulb 1, and slanted portions 622B which are continuous with the joining parts 621B and extend diagonally outward (downward as seen in FIGS. 8 & 9).

As shown in FIG. 6, both ends of the joining portions 621A in a radial direction of the bulb 1 are provided with portions 65A having a smaller width in the tube direction than the width of the slanted portions 622A, and the narrow parts 65A are formed so as to protrude from the outer edge of the strip-shaped portion 62A. Similar to the joining portions 621A, narrow parts 65B are formed on joining portions 621B.

A V-shaped cross section is formed between the plate-shaped bodies 60A, 60B in such a structure by bringing the joining portions 621A, 621B close together, having the slanted portions 622A, 622B mutually separate, fastening the joining portions together using the screws 63 which pass through holes formed in the narrow parts 65A, 65B, thereby forming the V-shaped cross section by the slanted portions 622A, 622B as shown in FIG. 8. In other words, as shown in FIGS. 8 & 9, the gap G which is formed between the slanted portions 622A, 622B widens in the direction along the tube axis of the bulb 1 toward the arc tube 11.

Figure 10:
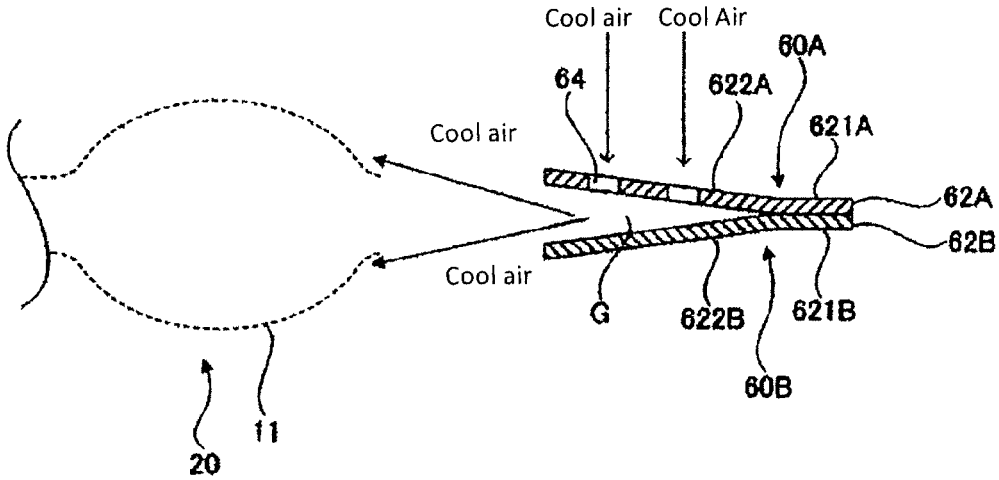
FIG. 10 is a conceptual view of the cooling air flow in the discharge lamp of the short arc type according to the present invention.

The discharge lamp 20 of the short arc type of the second embodiment in accordance with the invention can be expected to have the same effect as the discharge lamp 10 of the short arc type of the first embodiment. As shown by the arrows in FIG. 10, because the cooling air passing through the plate-shaped body 60A of the cooling fin 60 is directed toward the arc tube 11 of the bulb 1 and the sealing tube 12 is cooled through the cooling fin 60, the arc tube 11 can be cooled. Therefore, the lamp 20 in the second example makes it possible to lower the temperature of the discharge gas inside the arc tube 11 positioned upstream from the sealing tube 12, and makes it possible to cool the discharge gas passing through the inside of the sealing tube 12 which is downstream by cooling the sealing tube 12 between the cooling fin 60. In other words, the lamp 20 in the second embodiment can further lower the temperature of discharge gas flowing inside the sealing tube 12 through the synergistic effect between cooling the sealing tube 12 through the cooling fin 60 and cooling by bringing cooling air into contact with the arc tube 11.

Figure 11:
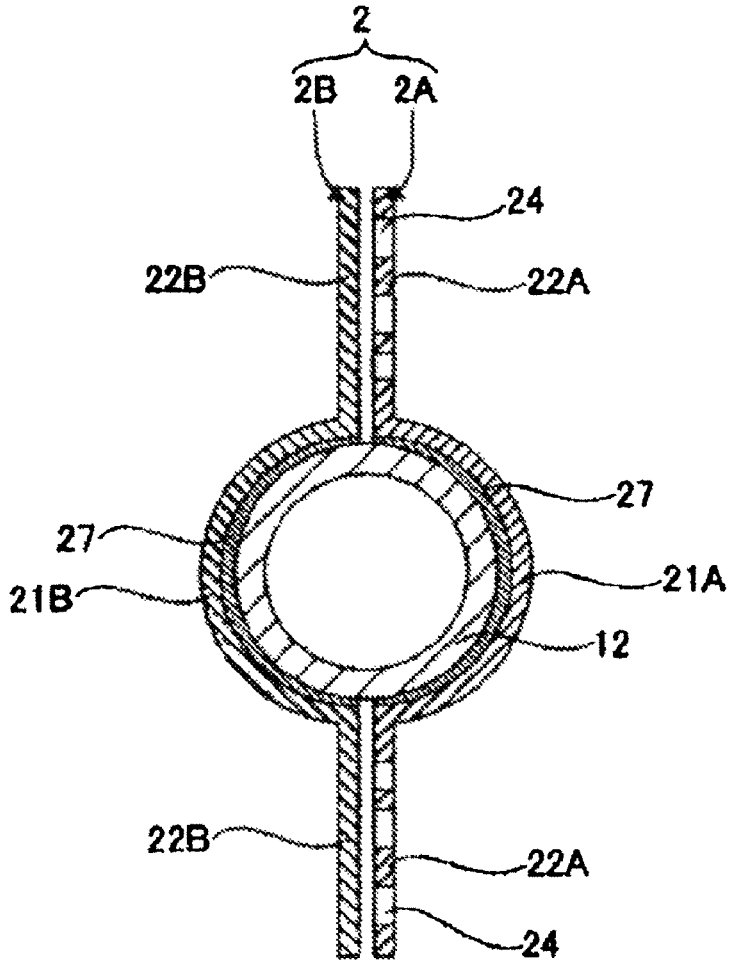
FIG. 11 is a cross-sectional view of another example of a discharge lamp of the short arc type of the present invention corresponding to that of FIG. 7.
Figure 12:
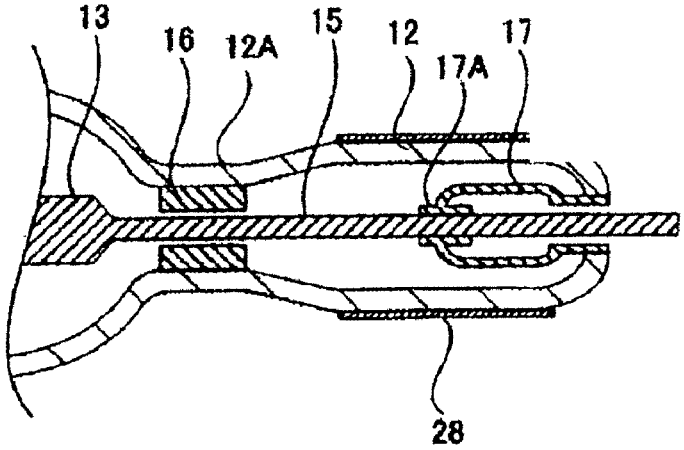
FIG. 12 is a cross-sectional view of another example of a discharge lamp of the short arc type of the present invention in which a heat absorbing material is disposed on the sealing tube.
Figure 13:
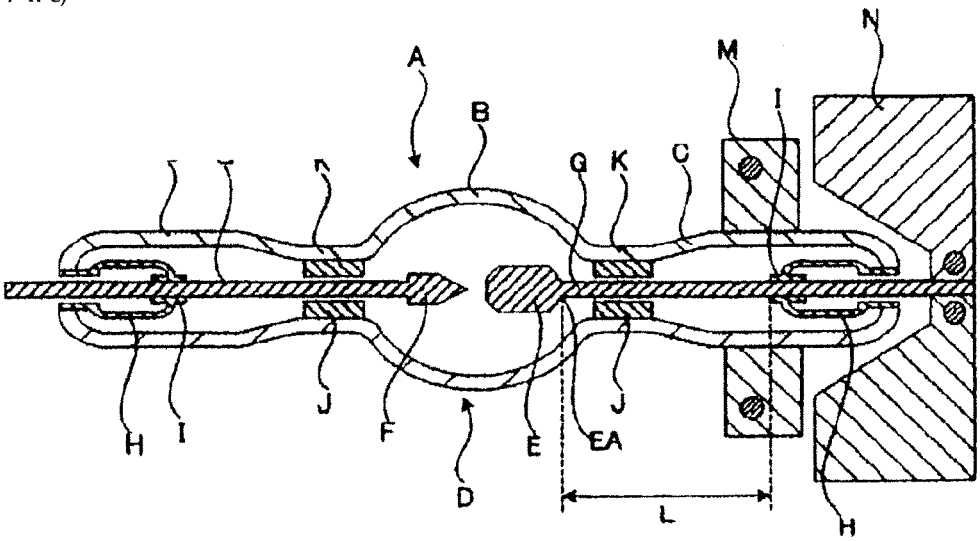
FIG. 13 (Prior Art)
FIG. 13 is a longitudinal cross-sectional view of the structure of a known discharge lamp of the short arc type.
Figure 14:
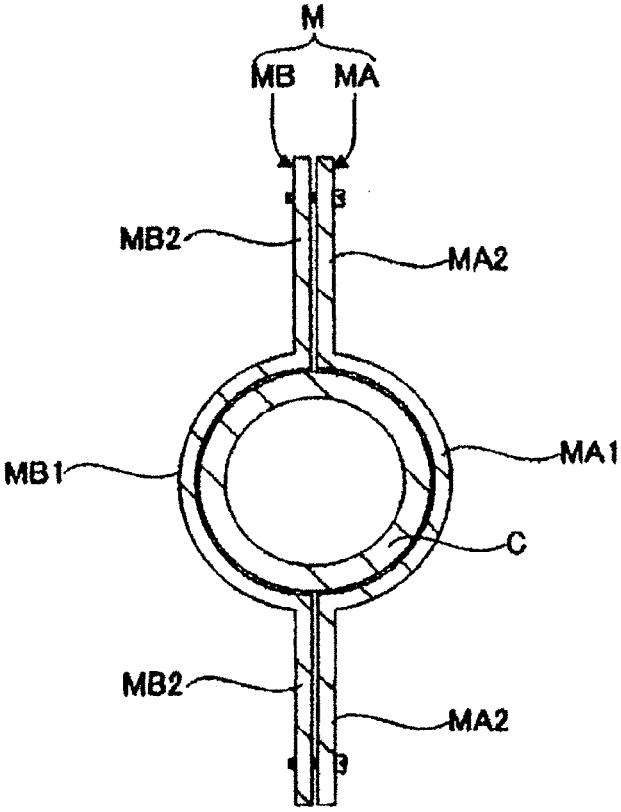
FIG. 14 (Prior Art)
FIG. 14 is a cross-sectional view of the structure of the cooling component in the sealing tube relating to the discharge lamp of the short arc type according to the present invention.

The discharge lamp of the short arc type relating to the first and second embodiments explained above can further improve the cooling effect of the sealing tube 12 by having a cooling fin structured as shown in FIGS. 11 & 12. The parts in FIGS. 11 & 12 which are the same as for the cooling fin shown in FIGS. 3 & 4 are given the same reference characters.

The cooling fin 2 shown in FIG. 11 comprises an inner surface which comes into contact with the outer surface of the sealing tube 12 in the curved portion 21A of first plate-shaped body 2A and an inner surface which comes into contact with the outer surface of the sealing tube 12 in the curved portion 21B of the second plate-shaped body 2B, both of which are covered by a heat absorbing material 27 composed of carbon, for example. The cooling effect that the cooling fin 2 has on the sealing tube 12 is thereby improved, so the temperature of the discharge gas inside the sealing tube 12 can be lowered further.

As shown in FIG. 12, the outer surface of the sealing tube 12 is covered across the entire outer surface thereof by a heat absorbing material 28 composed of carbon, for example. By bringing the heat absorption material 28 between the outer surface of the sealing tube 12 and the inner face of the curved portions 21A, 21B, the cooling effect which the cooling fin 2 has on the sealing tube 12 can be improved, thereby making it possible to farther lower the temperature of the discharge flowing inside the sealing tube 12. The cooling effect which the cooling fin 60 structured as shown in FIG. 7 and FIG. 8 has on the sealing tube 12 can of course be improved by adopting the structure shown in FIG. 11 and FIG. 12.

A discharge lamp of the short arc type was manufactured according to the following specifications, then a test was performed in which the temperature near the sealed portion of the graded glass shown by X in FIG. 1 was checked one hour after the discharge lamp of the short arc type was lit up.

<Lamp Specifications>

Bulb 1: Overall length 235 mm

Sealing tube 12: Quartz glass, outer diameter 24 mm, wall thickness 2.5 mm

Linear distance from graded glass 17 sealed portion 17A to anode 13: 59.5 mm Lead pins 15: Tungsten, diameter 4.0 mm Distance between electrodes: 4.0 mm Lamp power: 2 kW Sum of surface area of plate-shaped body 2A and surface area of plate-shaped body 2B (including the contact area with the sealing tube 12): 10600 $mm^2$ Sum of the contact area between the plate-shaped body 2A and the sealing tube 12 and the contact area between the plate-shaped body 2B and the sealing tube 12: 2030 $mm^2$ Material for plate-shaped bodies 2A and 2B: copper

TABLE 1

| | Temperature of Graded Glass Sealed Portion (° C.) |
|---|---|
| Lamp 1 (Conventional) | 482 |
| Lamp 2 (Invention) | 471 |

Table 1 shows the test results. In Table 1, the lamp 1 is a conventional lamp wherein no cooling air openings where formed in the cooling fin, and the lamp 2 as shown in FIG. 1 or FIG. 4 is a lamp in accordance with the present invention wherein cooling air openings are formed in one plate-shaped body which comprises the cooling fin.

As shown in Table 1, the temperature of the conventional lamp 1 was 482° C. and temperature of the lamp 2 in the present invention was 471° C. Therefore, the lamp 2 according to the present invention was confirmed to have a temperature more than 10° C. lower than the conventional lamp 1 at sealed portion X of the graded glass.

What is claimed is:

1. A discharge lamp of the short arc type, comprising:

a bulb with an arc tube and sealing tubes continuously extending from opposite sides of the arc tube, a discharge gas and a pair of opposed electrodes being located inside of the arc tube, a lead pin supporting each of the electrodes and protruding from an outer end of a respective one of the sealing tubes and being affixed to a graded glass in the sealing tube; and a cooling fin that surrounds an outer surface of one of said sealing tubes, the cooling fin comprising a pair of plate-shaped bodies each of which has a curved portion placed so as to contact the outer surface of said one of said sealing tubes and a strip-shaped portion extending radially outward from each of opposite edges of the curved portion, wherein the strip-shaped portions of the plate-shaped bodies positionally overlap, wherein cooling openings are formed on the strip-shaped portion of only one of the plate-shaped bodies in such a way that air passing through said cooling openings strikes against the strip-shaped portion of the other one of the plate-shaped bodies, and wherein the ratio of the surface area of the plate-shaped body which is not provided with openings to the total combined aperture areas of all of the cooling air openings is within a range of 20% to 30%.

2. The discharge lamp of the short arc type according to claim 1, wherein a gap is formed between said pair of plate-shaped bodies to allow cooling air to pass through said cooling openings to said arc tube.

3. The discharge lamp of the short arc type according to claim 2, wherein said gap gradually increases in a direction along the sealing tube toward said arc tube.

4. The discharge lamp of the short arc type according to claim 1, wherein a surface of the curved portion of the plate-shaped body that is in contact with said sealing tube is covered with a heat absorbing material.

5. The discharge lamp of the short arc type according to claim 1, wherein an outer surface of said sealing tube is covered by a heat absorbing material in the area of said cooling fin.

* * * * *